United States Patent [19]

Verneker

[11] Patent Number: 4,875,948

[45] Date of Patent: Oct. 24, 1989

[54] COMBUSTIBLE DELAY BARRIERS

[76] Inventor: Vencatesh R. P. Verneker, 8652 Concord Dr., Jessup, Md. 20794

[21] Appl. No.: 179,325

[22] Filed: Apr. 8, 1988

Related U.S. Application Data

[63] Continuation-in-part of Ser. No. 36,660, Apr. 10, 1987, Pat. No. 4,824,495.

[51] Int. Cl.[4] ..... C06B 45/14

[52] U.S. Cl. ..... 149/15; 149/14; 149/42; 149/43; 109/1 R; 109/23; 109/29; 109/36

[58] Field of Search ..... 149/14, 15, 42, 43; 109/1 R, 23, 29, 36

[56] References Cited

U.S. PATENT DOCUMENTS

| | | | |
|---|---|---|---|
| 888,052 | 5/1908 | Vaughn et al. | 109/37 X |
| 1,377,264 | 5/1921 | Menchen . | |
| 1,805,610 | 11/1928 | Young | 89/36.17 |
| 2,012,453 | 3/1930 | Lowy et al. | 89/36.17 |
| 3,266,959 | 8/1966 | Ackley | 149/19.4 |
| 3,294,602 | 12/1966 | Francis et al. | 149/15 |
| 3,309,249 | 3/1967 | Allen | 149/2 |
| 3,638,573 | 2/1972 | Campbell | 149/15 |
| 3,697,668 | 10/1972 | Campbell | 149/15 |
| 3,740,277 | 6/1973 | Poulin et al. | 149/15 |
| 3,802,970 | 4/1974 | Bishop et al. | 149/15 |
| 4,115,999 | 9/1978 | Diebold | 149/44 |
| 4,246,051 | 1/1981 | Garner et al. | 149/7 |
| 4,411,717 | 10/1988 | Anderson | 149/19.4 |
| 4,662,289 | 5/1987 | Harder | 109/49.5 |

*Primary Examiner*—Stephen J. Lechert, Jr.

[57] ABSTRACT

A combustible delay barrier for providing a delay to intrusion into an object. The delay barrier comprises a combustible layer containing a source of fuel such as a metal and/or a polymer and a source of oxygen such as an oxidizer. The combustible layer of the delay barrier is ignitable at a temperature in excess of about 300° C., during combustion is resistant to the effects of common fire extingushing materials, and is capable of sustaining combustion with a burn rate of no more than about six inches per minute.

13 Claims, 1 Drawing Sheet

COMBUSTIBLE DELAY BARRIERS

This application is a continuation-in-part of U.S. patent application Ser. No. 36,660 filed Apr. 10, 1987, now U.S. Pat. No. 4,824,495, issued Apr. 25, 1989.

The present invention relates generally to security measures for unattended objects such as structures, installations, buildings, equipment, vehicles, vaults, and the like and, more particularly, the invention relates to security measures in the form of combustible delay barriers which ignite upon intrusion and thus delay unauthorized entry or penetration of the object until appropriate authorities are alerted and are able to respond.

BACKGROUND OF THE INVENTION

Many objects, such as defined above, contain items of significant value and/or of a sensitive or proprietary nature such as to be inviting targets for intrusion by thieves, terrorists, spies and the like. In all too many instances, conventional security equipment to help prevent these intrusions is ineffective, too dangerous for normal use around authorized personnel, and/or is too expensive for the degree of security provided. Also, the use of armed guards or security personnel is very expensive, and in some instances, may be unreliable in the face of an intense attempted intrusion.

It has been previously proposed that certain types of combustible materials could be used as delay barriers in helping to prevent unauthorized entry into various objects. For example, U.S. Pat. No. 888,052 to Vaughn et al. discloses a burglarproof jacket for a safe or vault having inner and outer casings, with a coating of plaster containing an ignitable material such as match heads, as well as explosive material, between the casings. While this construction for a safe may be an effective deterrent to an intruder, the explosive nature of some of the materials renders the safe hazardous in the normal workplace and poses a real risk of destruction of the contents of the safe. Furthermore, since combustion is so rapid, an intruder could simply wait until combustion has ceased and then gain entry to the object.

Also, U.S. Pat. Nos. 1,805,610 and 2,012,453, to Young and Lowy et al., respectively, disclose vault and safe constructions which include a gas producing combustible material to help prevent entry into the safe when the safe wall is cut with a torch or the like. The gas produced by the combustible material is intended to be physically incapacitating to the user of the torch. The clear disadvantage of these safe constructions is that the incapacitating effect of the generated gas can be easily circumvented by the use of a gas mask or other gas protection equipment. Also, the combustion is not self-sustaining and it is possible to quench the combustion with conventional fire extinguishing materials such as water.

SUMMARY OF THE INVENTION

It is therefore a feature of the present invention to provide a combustible delay barrier for preventing unauthorized entry into an object.

It is another feature of the invention to provide a combustible delay barrier for an object which gives the object a high degree of security.

Another feature of the combustible delay barriers of the subject invention is that the barriers are relatively safe against accidental ignition.

Yet a further feature of the combustible according to the present invention is that the barriers are made of readily available and inexpensive materials, and are relatively light in weight.

Yet another feature of the combustible delay barriers of the invention is that they are non-explosive and thus can be transported and used relatively safely.

Another feature of the combustible delay barriers of the invention is that the barriers upon ignition need not, but can, destroy the object with which the barrier is associated.

Briefly, the present invention in its broader aspects comprehends a combustible barrier for providing a delay barrier to an intrusion into an object, barrier comprising a combustible layer, a polymeric layer, at least one metal layer, and optionally, a water resistant layer, a heat resistant layer, and/or an electrostrictive layer. The combustible layer comprises a source of fuel and an oxidizer, in the form of a homogeneous mixture. The combustible layer is ignitable at a temperature in excess of about 300° C. During combustion, it is resistant to common fire extinguishing materials and is capable of sustaining combustion for an extended time period with a burn rate of from about one to four inches per minute. The preferred combustible layer comprises oxidizer and a fuel metal, and is from about 0.12 to about 0.50 inches thick.

Another feature of the present invention is to provide a combustible coating material for use in a delay barrier, wherein the coating is comprised of a substantially homogeneous mixture of fuel, oxidizer, and, optionally, binder.

Further objects, advantages, and features of the present invention will become more fully apparent from a detailed consideration of the following description taken together with the accompanying drawings.

DETAILED DECRIPTION OF THE PREFERRED EMBODIMENTS

Figure 1:
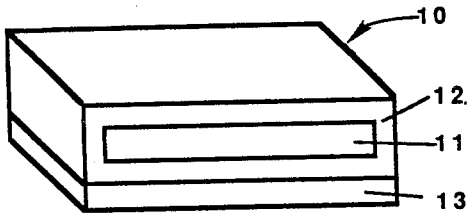
FIGS. 1–5 are perspective views, partially in section, of various delay barriers according to the invention.

The combustible delay barriers of the present invention are used to protect objects, such as buildings, vaults, and equipment, by providing a covering which ignites upon an attempted intrusion into the objects. An attempt to break through the barrier to gain access to the object will result in the formation of a flame front at the point of intrusion, which acts to delay access to the object. Accordingly, the combustible delay barriers of the present invention may comprise a variety of elements which act to provide the desired intrusion delaying function. As a minimum, the delay barrier must consist of a combustible layer, a polymeric layer, which preferably encases the combustible layer, and at least one metal layer. The combustible layer acts to produce the desired flame front, while the polymeric layer acts to control the burn rate of the combustible layer. The metal layer is utilized to ignite the combustible layer, in that tools used by an intruder to cut through the metal layer would create sparks or heat which cause ignition of the combustible layer. In addition, the metal layer may act to structurally support the combustible and polymeric layers. Optionally, the delay barrier may comprise elements, such as a water resistant layer, a heat resistant layer, and/or an electrorestrictive layer, which act to modify the characteristics of the delay barrier.

The composition of the combustible layers and coatings according to the present invention may comprise a wide variety of constituents in widely varying proportions. The constituents and their proportions for the compositions must, however, be selected such that four important criteria are met; that is, the compositions must ignite at a relatively high temperature, the compositions are non-explosive, the compositions must burn relatively slowly for a long period of time, and be resistant to quenching or extinction.

More specifically as to the first criteria, a relatively high ignition point for the combustible layer or coating is necessary to prevent accidental ignition by low energy contact with the delay barrier. This enables authorized persons to use the object for its intended purpose without fear of injury or damage to the object. Generally, the ignition temperature of the combustible layer for safety purposes should be in excess of about 300° C., and preferably in excess of about 400° C. With such an ignition temperature, the combustible layer will not ignite upon penetration by a bullet or other high velocity component, but will ignite under the thermal heat generated by a power saw, an explosive charge, or the like.

As to the second and third criteria, the basic consideration is that the delay barrier burn for a long enough period of time near the point of intrusion such that an intruder would be held at bay until appropriate authorities arrive and secure the object. As is evident, the exact time period of combustion for a particular barrier may be varied according to the type of object to be protected by the delay barrier and its location relative to personnel capable of responding to an attempted unauthorized entry. In some situations, a combustion period of as little as five minutes may be sufficient, whereas in other situations, combustion periods of up to one hour or more may be necessary. In the same view, the combustion should also be relatively slow such that explosive combustion cannot occur which would most likely damage or even destroy the object being protected, or surrounding structures or areas of buildings. Further, if the delay barrier was of an explosive nature, transportation, installation and handling of the barrier would be quite hazardous and subject to special rules and regulations, and perhaps even prohibited on the grounds of safety. The delay barrier should be capable of rapid, yet non-explosive combustion. Thus, the combustible layer or coating should be of an incendiary or pyrotechnic material.

In another manner of viewing this criteria, the combustible layer or coating should have a so-called "burn rate," i.e., the linear amount of combustible layer combusted or burned per unit of time, which is balanced between a rapid rate, which could consume the combustible layer in a short period of time or even explosively, and thus render the delay barrier essentially ineffective, and a relatively slow rate which would not provide a sufficiently delaying barrier for an intruder. In general terms, it has been found that a burn rate of at least about one half inch per minute to about six inches per minute, and preferably of at least about one inch per minute up to about three to four inches per minute, and more preferably about two inches per minute, is satisfactory for most purposes. A burn rate greatly in excess of these rates, e.g., above twenty inches per minute, will not provide effective delay protection as the combustible layer would be consumed too quickly in the area of the intrusion. In accordance with the invention, appropriate selection of the constituents of the combustible layer and their relative amounts can be made so as to achieve the desired burn rate for an effective delay barrier.

The final criteria is that the combustion of the combustible layer or coating be substantially uneffected by conventional fire extinguishing materials such as water, carbon dioxide, foam, and the like. Such a capability is of course necessary as otherwise an intruder could easily circumvent the inhibiting nature of the delay barrier by simply extinguishing the combustible layer and thereby gaining access to the object.

A general class of particularly effective compositions for combustible layers and coatings according to the invention comprises a source of fuel and a source of oxygen in sufficient amounts that the combustible layer is non-extinguishable. Presently preferred combustible layers according to the invention comprise a substantially homogeneous, three component mixture of an oxidizer, a fuel metal, and a binder which also serves as a source of fuel. Suitable oxidizers include ammonium and alkali metal nitrates and perchlorates, such as ammonium nitrate ($NH_4NO_3$), potassium nitrate ($KNO_3$), sodium nitrate ($NaNO_3$), ammonium perchlorate ($NH_4ClO_4$) and potassium perchlorate ($KClO_4$). Suitable metals include one or more of aluminum, iron, lithium, beryllium, boron and magnesium, preferably in finely divided particulates, chopped foil or other easily combustible form, and alloys of such metals. Preferred metals are those, such as magnesium, which release the greatest amount of heat upon combustion. Binders which can serve as a fuel include carbonaceous materials such as asphalts, rubbers and natural and synthetic polymers, particularly inexpensive and lightweight polymers such as polystyrenes, polybutadienes, polyamides, polyesters, polysulfides and polyurethanes. The binder also provides a convenient vehicle for adhering the layer to an object or other desired substrate.

The relative proportions of oxidizer, metal and binder in the presently preferred combustible layer compositions may vary considerably while still enabling the combustible layer to fall within the framework of the above criteria. It has been generally found that the oxidizer should comprise the major amount of the composition, that is, the largest single constituent, whereas the metal and binder components should comprise minor amounts of the composition, that is, amounts less than the oxidizer, generally in relatively equal amounts. For example, compositions of about 40–80 weight percent oxidizer, preferably 40–70 weight percent, about 5–25 weight percent metal fuel, and the remainder fuel binder, have been found to provide satisfactory combustible layers for the purposes of the present invention. Varying the relative amounts of the three components enables the ignition temperature, burn rate and flame temperature of the combustible layer to be varied.

In addition to the above components, the combustible layers may include additional ingredients, particularly those common to solid propellant compositions. Such additional ingredients may include curing agents, fillers, bonding agents, stabilizers, surface active agents and the like.

In another embodiment of the present invention, the combustible layer or coating is incorporated in a honeycombed cell-like structure made of, for example, a metal or a polymeric material. Suitable honeycomb cell wall materials include imperforated and perforated aluminum, copper, fiberglass, steel, paper and polymers such as polypropylene, polyethylene, polystyrene and polycarbonate. Perforated honeycomb structures may have a plurality of minute orifices in the cell walls which assist in the migration of gases and thus promote flame propagation between cells. The cell dimensions in terms of height and distance across each cell can vary considerably. Honeycombed or cell-like structures of this nature may be adhered to a surface of the structure to be protected by conventional bonding techniques, or may be utilized, for example, as a layer in a laminar structure. Thus, a honeycomb including the combustible coating material of the present invention may be placed between two metal plates to form an intrusion resistant barrier structure. As utilized herein, the term combustible layer is understood to include such embodiments.

With such a composite combustible layer structure, adjacent cells are somewhat isolated from each other and thus combustion proceeds progressively from one cell to another in a controlled rate of combustion. In addition, the honeycomb structure for the combustible layer provides structural reinforcement which helps prevent the delay barrier from separating from the object to which it is adhered when subjected to large forces such as those encountered upon impact by a linear shape charge.

As a general proposition, the height of the flame produced by the combustible layer is dependent on the thickness of the layer. For example, a combustible layer comprising about 60 weight percent ammonium perchlorate, about 20 weight percent magnesium and about 20 weight percent polyurethane, having a thickness of about one half inch, is capable of producing a flame of four to five feet in height. In most applications, a flame of this magnitude is sufficient to deter a would-be intruder and thus provide an effective delay to intrusion.

The compositions forming the combustible layers and coatings of the invention can be prepared in a variety of manners. In some instances, a simple mixture of the components may suffice. In others, it may be appropriate to mix the oxidizer and metal with a fuel binder precursor such as a monomer or prepolymer and then polymerize or cure the precursor. The binder can also be mixed with a suitable solvent or the like, followed by driving off the solvent by heat or vacuum.

Figure 2:
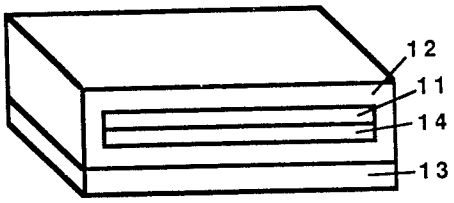
Figure 3:
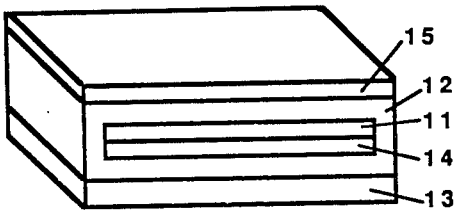
Figure 4:
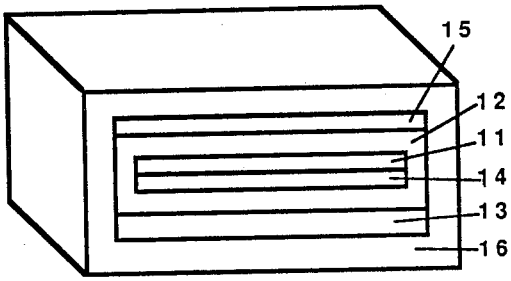
Figure 5:
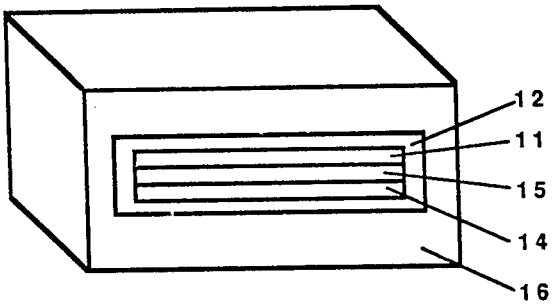

In FIG. 1, delay barrier 10 consists of a combustible layer 11 encased in a polymeric layer 12 which is secured to a metal substrate 13. FIG. 2 is similar to FIG. 1, with the addition of a water resistant layer 14 disposed adjacent to combustible layer 11 and encased in polymeric layer 12 which is secured to the metal substrate 13. FIG. 3 illustrates combustible layer 11 adjacent to water resistant layer 14, both of which are encased in polymeric layer 12. Metal substrate 13 is secured to one of the outer faces of polymeric layer 12, while metal mesh layer 15 is secured to another face of the polymeric layer 12. FIG. 4 is similar to FIG. 3, with the addition of a heat resistant layer 16 which encases the combustible layer 11, water resistant layer 14, polymeric layer 12, metal substrate 13 and metal mesh layer 15. FIG. 5 illustrates a delay barrier in which metal mesh layer 15 is disposed between combustible layer 11 and water resistant layer 14. These three layers are encased in polymeric layer 12, which in turn is encased in heat resistant layer 16. It is noted that if it is desired to securely attach adjacent layers, adhesives may be used between the layers.

A preferred composition for the combustible layers described above consists of a substantially homogeneous mixture of about 60 weight percent ammonium perchlorate, about 20 weight percent magnesium and about 20 weight percent polyurethane. Preferred thicknesses for the combustible layers range from about $\frac{1}{8}$ to about $\frac{1}{2}$ inch.

The water resistant layers preferably consist of about 80 weight percent magnesium and about 20 weight percent polyurethane. The thickness of the water resistant layers may range from about $\frac{1}{8}$ to about $\frac{1}{4}$ inch. The polymeric layers preferably comprise polyurethane and may optionally be loaded with fillers such as glass and the like. The polymeric layers have the effect of slowing down combustion of the delay barrier and hence lessen the chance for an explosive-type combustion. Preferred polymeric layer thicknesses range from about $\frac{1}{8}$ to about $\frac{1}{4}$ inch.

The metal substrate and metal mesh layers may comprise any suitable metal, including aluminum and steel. A preferred metal substrate consists of aluminum plate having a thickness of approximately $\frac{1}{4}$ inch. A particularly preferred metal mesh layer consists of perforated steel plate having a thickness of about 1/16 inch.

The heat resistant layer may comprise any suitable refractory material and may range in thickness from about $\frac{1}{8}$ to about $\frac{1}{2}$ inches. A preferred heat resistant layer consists of $\frac{1}{4}$ inch thick fiberfrax. In use, such heat resistant layers may be utilized to protect the object from fire damage caused by ignition and combustion of the combustible layer.

It is to be noted that a wide range of layer configurations are possible for the delay barriers of the present invention. Accordingly, variations in placement of the layers, along with the use of additional layers of material, are considered to be within the scope of the present invention. In addition, certain elements, such as the metal substrate, may be replaced by other elements, such as the metal mesh layer. For example, in FIGS. 3 and 4, the metal substrate 13 may be replaced by an additional layer of metal mesh.

A further embodiment of the present invention involves the use of pressure sensitive electrostrictive layers within the delay barrier device. The electrostrictive layers are connected, via conventional electronic circuitry, to an alarm, or other suitable device, to thereby provide a signal upon the application of pressure to the delay barrier. Thus, an attempt to break through the delay barrier, by means such as cutting or the use of explosives, will result in the formation of an electric field within the electrostrictive material which will then trigger an alarm or other warning signal. The electrostrictive layer may be placed at various locations within the delay barrier. For example, the electrostrictive layer may be disposed adjacent to the combustible layer and encased within the polymeric layer. Alternatively, an electrostrictive layer composed of polymeric material may be used in place of the polymeric layer. A preferred composition for the electrostrictive layer is polyvinylidene fluoride ($pvF_2$). Similarly, the combustible layer may include electrostrictive material, such as ammonium perchlorate oxidizer, in which case, the combustible layer is additionally utilized to perform the function of an electrostrictive layer. Heat sensitive alarm layers may be similarly disposed.

As was mentioned previously, the combustible delay barriers as disclosed herein are suitable for application to a wide variety of objects to provide a delay to entry into the object, to thereby help maintain the security of the object and/or its contents. Particular objects contemplated for being protected include structures, equipment, installations, buildings, vehicles, safes, and vaults. More specific applications include electrical equipment such as computers and related hardware, weapon systems, and protected buildings such as military and defense installations and commercial facilities, particularly those buildings subject to terrorist attacks, such as power plants, arsenals, and other weapons depositories. It should be recognized that the above examples are merely illustrative of the broad applications of the invention and many others will be evident to those of skill in the art.

The following examples illustrate specific compositions for the combustible layers in accordance with the present invention. It should be understood that the examples are given for the purpose of illustration and do not limit the invention as has been described. In the examples, all parts and percentages are by weight unless otherwise specified.

EXAMPLE 1

Various styrene-based compositions for combustible layers according to the invention were prepared and then combusted to determine the ignition temperature and burn or flame temperature. The samples were prepared by mixing oxidizer and particulate metal with uncured styrene, depositing the mixture on an aluminum plate and then polymerizing the styrene in an oven maintained at about 70° C. over a 24 hour period. After cooling, the samples were ignited by an electric igniter and the flame temperature measured by a thermocouple. The results of the ignition and burn temperature tests are set forth in the following Table I along with the particular compositions for each combustible layer.

TABLE I

| Sample Composition | Ignition Temperature | Burn Temperature |
|---|---|---|
| 50% $NH^4NO^3$<br>30% Styrene<br>20% Al | 390° C. | 450–500° C. |
| 40% $NH_4NO_3$<br>40% Styrene<br>20% Al | 390° C. | 500–550° C. |
| 70% $NH_4NO_3$<br>20% Styrene<br>10% Mg | 390° C. | 300–400° C. |
| 60% $NH_4NO_3$<br>30% Styrene<br>10% Mg | (1) 270° C.<br>(2) 330° C. | 400–450° C. |
| 60% $NH_4NO_3$<br>30% Styrene*<br>10% Mg | 300° C. | 400–450° C. |
| 50% $NH_4NO_3$<br>40% Styrene<br>10% Mg | 370° C. | 400° C. |
| 50% $NH_4NO_3$<br>40% Styrene*<br>10% Mg | 390° C. | 500–550° C. |
| 50% $NH_4NO_3$<br>30% Styrene*<br>20% Mg | 335° C. | 300–350° C. |
| 50% $NaClO_4$<br>40% Styrene<br>10% Al | 400° C. | 300° C. |
| 50% $NaClO_4$<br>40% Styrene*<br>10% Al | 400° C. | 350–400° C. |
| 50% $NaClO_4$<br>30% Styrene*<br>20% Al | 400° C. | |
| 40% $NaClO_4$<br>40% Styrene<br>20% Al | 400° C | 350–550° C. |
| 70% $NaClO_4$<br>20% Styrene<br>10% Mg | 390° C. | 400° C. |
| 60% $NaClO_4$<br>30% Styrene<br>10% Mg | 400° C. | 350–400° C. |
| 50% $NaClO_4$<br>40% Styrene<br>10% Mg | 400° C. | 400–450° C. |

*partially polymerized

EXAMPLE II

One of the combustible layer compositions of Example I was then tested for its ability to ignite or not ignite under various conditions that might be encountered in providing a delay against unauthorized entry into an object. The composition used was 60 percent ammonium nitrate, 20 percent magnesium and 20 percent polystyrene, prepared as in Example I. Two samples were prepared, one a ¼ inch thick layer on a foot square piece of aluminum, and the other a similar layer on a steel substrate. Neither of the combustible layers ignited when pierced by a rifle bullet. Penetration by an electric saw ignited the combustible layer and although the fire was violent, the layer burned for only a few seconds. A linear shape charge blew away most of the combustible layer, but what remained burned violently. It was noted that the compositions tended to be somewhat brittle, did not have particularly good adherence to the substrate and tended to burn rapidly.

EXAMPLE III

Various polyurethane-based compositions for combustible layers according to the invention were prepared and then combusted to determine their ignition temperature. The results are set forth in the following Table II, along with the particular compositions for each of the layers.

TABLE II

| Sample Composition (wt. %) | | | Ignition Temperature |
|---|---|---|---|
| $NH_4ClO_4$ | Urethane | Mg | |
| 60 | 20 | 20 | 370° C. |
| 60 | 20 | 20 | 350° C. |
| $NH_4NO_3$ | Urethane | Mg | |
| 50 | 30 | 20 | 400° C. |
| 60 | 20[1] | 20 | 370° C. |
| 60 | 30 | 10 | 400° C. slow igniting |
| 60 | 20[2] | 20 | 385° C. |
| 60 | 20 | 20 | 385° C. |
| 60 | 30 | 10 (Al) | 320° C. |
| 60 | 25 | 15 | 350° C. |
| 60 | 25 | 15 (Al) | 350° C. |

Notes:
[1]85% polyurethane, 15% curing agent
[2]95% polyurethane, 5% curing agent As is apparent from the above, all samples tested had an ignition temperature in excess of 300° C., and thus all fall within the first criteria for the combustible layers of the invention.

EXAMPLE IV

One of the samples of Example III was then tested as to its potential for ignition after being subjected to a variety of conditions and events. The composition tested contained about 60 percent ammonium perchlorate, about 20 percent polyurethane and about 20 percent magnesium.

The combustible layer was found not to ignite after ballistic tests using NATO 7.62 mm M-80 ball rounds. The burning rate after ignition by a linear shaped charge or an electric saw was about two inches per minute. The combustion started by the latter two means could not be extinguished by either a Class D type fire extinguisher or by water flowing at 5.0 gpm/sq. inch, or even greater, and ignition occurred even if the combustible layer sample was maintained at a temperature as low as −50° F.

One sample of the combustible coatings was subjected to platter charge attack, and in seconds a hole was created in the barrier by the platter charge. Combustion was immediately initiated and was sustained until the entire layer was consumed.

EXAMPLE V

A combustible coating similar to that of Example IV was prepared and formed into four samples of varying length. Each sample was coated with a ¼ inch layer of polyurethane and then ignited to determine the burn rate for each sample. The results are set forth in the following table:

TABLE III

| Sample No. | Tray Length (inches) | Burn Time (sec.) |
|---|---|---|
| 1 | 2 | 61 |
| 2 | 4 | 115 |
| 3 | 6 | 105 |
| 4 | 12 | 183 |

When this data are presented graphically, it indicates that this particular embodiment of the invention has an approximate burn rate of about 2–4 inches per minute, well within the criteria set forth previously.

EXAMPLE VI

A composition comprising about 60 percent ammonium perchlorate, 20 percent polyurethane, and 20 percent magnesium was prepared, applied to an aluminum substrate, and encapsulated in a one inch thermal insulating layer of Fiberfrax . This structure was tested to evaluate rate of combustion and confinement of the combustion. It was found that use of a thermal barrier of this type enables one to control spread of the combustion, permitting use of the barrier layer in confined areas or in proximity to other flammable materials.

In summary, the delay barriers of the present invention can provide an effective deterrent against entry into an object by an intruder. The barriers are relatively safe for transportation and for use on various objects such as buildings and equipment, have a relatively long shelf life, and can be made from relatively inexpensive materials.

While there has been shown and described what are considered to be preferred embodiments of the present invention, it will be obvious to those skilled in the art that various changes and modifications may be made therein without departing from the invention as defined in the appended claims.

What is claimed:

1. A delay barrier comprising a combustible layer containing a mixture of fuel and oxidizer, a polymeric layer encompassing said combustible layer, and at least one metal layer disposed adjacent to a surface of the polymeric layer not in contact with the combustible layer.

2. A delay barrier as set forth in claim 1, further comprising a water resistant layer disposed adjacent to the combustible layer and encased within the polymer layer.

3. A delay barrier as set forth in claim 1, wherein at least one metal layer comprises steel mesh.

4. A delay barrier as set forth in claim 3, wherein one metal layer is a substrate.

5. A delay barrier as set forth in claim 1, further comprising a heat resistant layer which encases the combustible polymeric and metal layers.

6. A delay barrier as set forth in claim 1, wherein said polymeric layer comprises an electrostrictive material.

7. A delay barrier as set forth in claim 6, wherein said electrostrictive material is polyvinylidene fluoride.

8. A delay barrier as set forth in claim 6, further comprising an electrical circuit in contact with said electrostrictive material.

9. A delay barrier as set forth in claim 8, wherein said circuit comprises an alarm circuit.

10. A delay barrier as set forth in claim 1, further comprising an electrostrictive layer disposed adjacent to the combustible layer and encased within the polymeric layer.

11. A delay barrier as set forth in claim 1, wherein said fuel comprises particulate metal.

12. A delay barrier as set forth in claim 11, wherein said oxidizer is selected from ammonium nitrate, potassium nitrate, sodium nitrate, ammonium perchlorate, potassium perchlorate, and mixtures thereof.

13. A delay barrier as set forth in claim 11, wherein said oxidizer comprises potassium nitrate, and said metal is selected from aluminum, magnesium, and iron.

* * * * *